US007013842B2

(12) United States Patent
Loving

(10) Patent No.: US 7,013,842 B2
(45) Date of Patent: Mar. 21, 2006

(54) WATER HEATING CHAMBER SYSTEM

(76) Inventor: Ronald E. Loving, 114 Diamond Way, Fernley, NV (US) 89408

( * ) Notice: Subject to any disclaimer, the term of this patent is extended or adjusted under 35 U.S.C. 154(b) by 0 days.

(21) Appl. No.: 11/188,514

(22) Filed: Jul. 25, 2005

(65) Prior Publication Data

US 2006/0016401 A1 Jan. 26, 2006

Related U.S. Application Data

(60) Provisional application No. 60/590,806, filed on Jul. 23, 2004.

(51) Int. Cl.
*F22B 21/26* (2006.01)

(52) U.S. Cl. ..... 122/250 R; 122/244; 122/169; 237/19

(58) Field of Classification Search ..... 122/276, 122/239, 244, 246, 247, 249, 250 R, 250 S, 122/251, 252, 169; 237/19
See application file for complete search history.

(56) References Cited

U.S. PATENT DOCUMENTS 2,823,652 A * 2/1958 Mader ..... 122/250 R
2,904,014 A * 9/1959 Meyers ..... 122/33
6,152,086 A * 11/2000 Brouwer et al. ..... 122/249

* cited by examiner

*Primary Examiner*—Gregory Wilson

(57) ABSTRACT

A system that is used for converting polluted gases into a heat source for production of hot water. The system provides a combustion chamber, an incinerator chamber and mixing and/or water-heating chamber all of which are in-line with each other and contained within appropriate housings. The mixing/and/or water-heating chamber further provides an arrangement of coils for control and heating of the water. Also appropriate ignition means, a blower and the like are included for full efficiency so as to provide a clean burning, environmentally friendly system for production of hot water.

6 Claims, 1 Drawing Sheet

WATER HEATING CHAMBER SYSTEM

RELATED PRIOR ART

This application pertains to my provisional application No. 60/590,806 that was filed on Jul. 23, 2004 in the name of the present inventor, which as of now is being converted into a utility application accordingly. It is to be noted the filing date for the present application is Jul. 25, 2005 as the 23$^{rd}$ was a Saturday, thus the present utility application has been timely filed.

FIELD OF THE INVENTION

This invention in general relates to devices and/or methods used to provide energy efficient and economical means for producing hot water and steam. However, the present invention more particularly pertains to a device that is contained within an elongated tubular housing forming a combustion chamber, an incinerator chamber, and a mixing and/or water heating chamber arranged inline therein, and incorporates novel coiled water pipes, a fuel injection system, ignition means, a blower, a controller, etc.

BACKGROUND OF THE INVENTION

As taught within the known prior art, gaseous or liquid fuels can be easily converted to produce heat in many ways. However, such devices are very limited in use and cannot be easily transported to remote locations without increased costs, as they are not designed to be portable. These devices are somewhat functional for intended use but they still remain inefficient, they are not environmentally friendly, and they are much too costly to manufacture and operate.

Reducing air pollution, particularly pollution exhausted from a heat-producing source has been very difficult to accomplish. Thus there have been numerous attempts without complete success and as a result there is still a great need for improvements and a device that addresses and resolves the problems associated with the known prior art in a manner heretofore not taught. Emissions and noxious odors emitted from heat producing sources has become a strong environmental concern both in the United States and around the world. Because of worldwide tightening of pollution emission standards, inventors are continuously trying to invent devices and methods that will meet these increasingly stringent regulations and still keep the infrastructure in place that allows for such devices to be used for heating of water and steam. Thus, there is a great need for a device such as the present invention which can produce hot water and/or steam in a manner that is environmentally friendly, efficient, economical, and also eliminates noxious odors and destroys organic and inorganic particulates associated with pollution.

SUMMARY OF THE INVENTION

It is therefore a primary object of the present invention to provide a water-heating chamber system that overcomes the aforementioned problems of producing hot water or steam cleanly without polluting the air by continuously eliminating virtually all particulate matter and hydrocarbons from the exhaust of the system.

It is another object of the present invention to provide a water-heating chamber system that is economical to manufacture, is cost effective to operate, is environmentally friendly, is easy to use and may be easily transported to remote locations.

Yet another object of the present invention is to provide a water-heating chamber system that is compact and contained within an elongated tubular housing, with each of the components being arranged in-line in a new and novel manner heretofore not taught.

Other objects and advantages will be seen when taken into consideration with the following specifications and drawings.

DETAILED DESCRIPTION OF THE DRAWING

Figure 1:
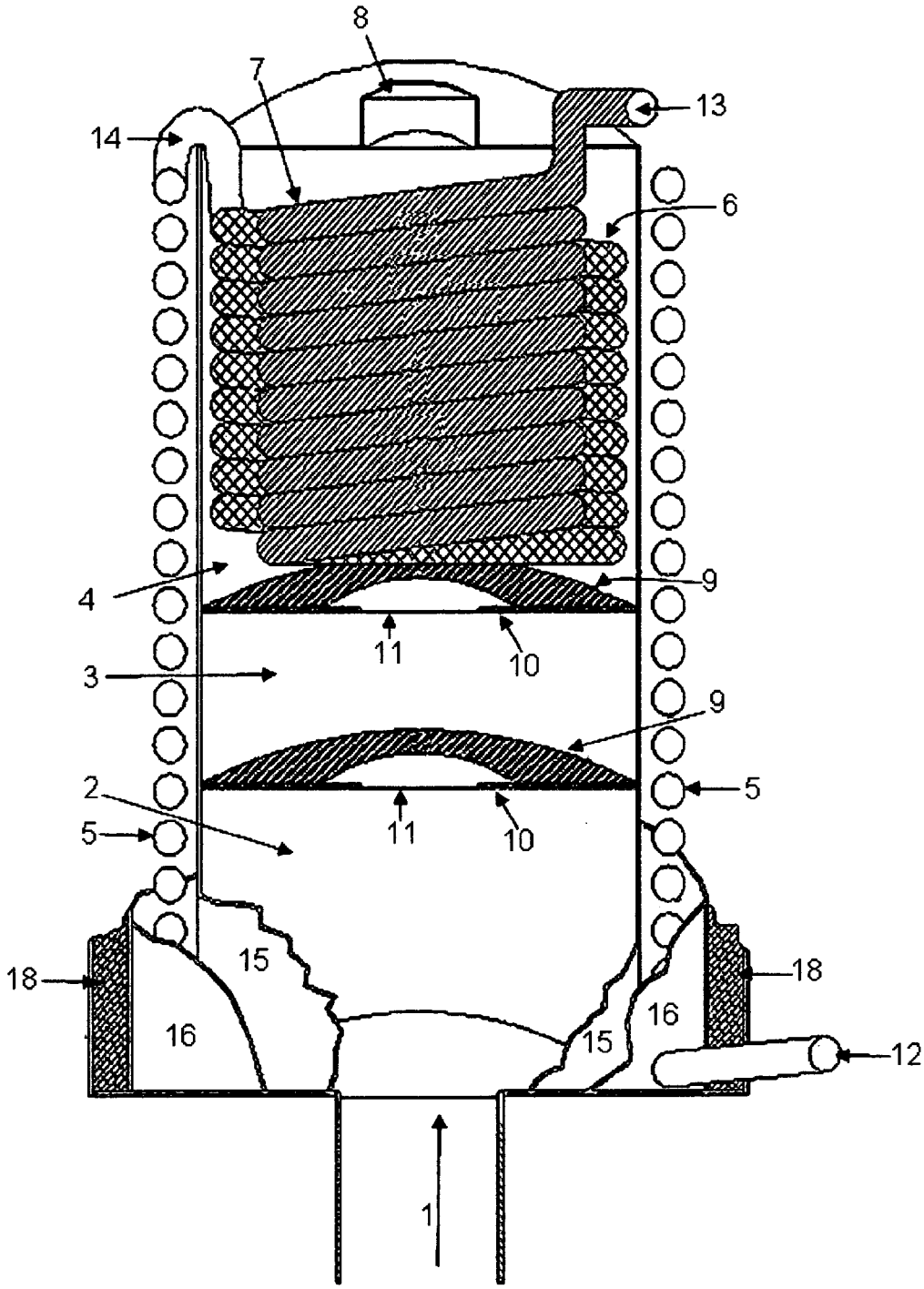
FIG. 1 is a diagrammatic representation of a sectional view of the preferred embodiment for the water heating system of the present invention.

Referring now in detail to the drawing wherein like characters refer to like elements throughout the various views. Depicted in FIG. 1, is the preferred embodiment for the water heating system of the present invention in accordance with the present inventive concepts.

The water heating system of the present invention is contained within an exterior housing (16), however it is only partially shown for clarity purposes. The exterior housing (16) is substantially cylindrical in shape and is made from a metal shell containing an insulated material (18) to contain heat and thereby improve system efficiency and economy. It is to be understood any type of suitable insulating material of engineering choice may be used.

Contained within exterior housing (16) is an elongated tubular member (15) that is again only partially shown for clarity purposes. The elongated tubular member (15) is spaced apart from exterior housing (16) and forms an internal space there between, respectively. Elongated tubular member (15) is substantially partitioned by multiple turbulator disks (10) so as to form a combustion chamber (2), an incinerator chamber (3) and a mixing and/or water-heating chamber (4), each of which are in open communication with each other via a centralized turbulator opening (11), and each of the chambers (2, 3 & 4) are arranged in sequence in-line. The turbulator disks (10) not only function as a partition means but further cause turbulence to create dwell time or delay of the gases when passing from one chamber to the next. Whereby each of the chambers (2, 3 & 4) are designed to retain the gases and cause delay before allowing the gases to proceed out to the next chamber or exit the system. This delay or dwell time is very important as this provides for more complete combustion and decomposition of the hydrocarbon fuel.

Combustion chamber (2) includes an inlet duct (1) for receiving ignited fuel and air mixture that is blown there through from a blower (not shown). The actual blower mechanism is not herein taught as many variations of suitable blowers exist, and such blower mechanisms are well known within the field. However, the blower mechanism used to provide fresh air is to be powered by a motor capable of providing enough fresh air to sustain the combustion process within the combustion, incinerator and mixing chambers. The blower motor blows fresh air through the inlet air passageway (not shown) disposed within the exterior housing (16) and then into the combustion chamber (2) via inlet duct (1). Whereby, when the correct amount of fuel and fresh air is added to the combustion chamber (2) a primary turbulence zone is established. In this zone the mixture will be ignited and burn with a very hot flame just inside the combustion chamber (2). This hot flame indicates near total combustion of the fuel being injected into the chamber (2). The ignited fuel and air mixture in the center of the turbulence zone is kept in place by the velocity of the incoming fresh air and fuel as supplied.

It is to be further noted the present invention incorporates a fuel injector system (not shown) and which again may be any suitable type according to engineering choice. However, the system is so designed as to be capable of converting any liquid fuel from a liquid to an atomized gaseous fuel prior to being injected into the combustion chamber (2). Although, if the fuel to be used in the combustion chamber is already in a gaseous state then an atomizer system is not needed. Thus, the fuel injector system can be made to be selectable between the two types of fuel gas, or liquid.

The water-heating chamber of the present invention further includes an outside coil arrangement (5) located within the internal space formed between elongated tubular member (15) and exterior housing (16), respectively. Further contained within the mixing and/or water-heating chamber (4) is an outer coil arrangement (6), and an inner coil arrangement (7). Outside coil arrangement (5) provides a fresh water inlet (12) for receiving fresh water (not shown) therein and a transition tube (14) for delivery to outer coil arrangement (6) and inner coil arrangement (7) provides a hot water outlet (13). Other components of the system include an exhaust port (8) and flow conditioners (9). The flow conditioners are important as this allows the gases to flow in a controlled manner within each of the chambers (2, 3 & 4) in a direction that will also help the delaying of the gases from flowing from one chamber to the next. Also, this prevents the gases from flowing straight out of the chamber system through each of the centralized turbulator openings (11).

The actual process or method comprises the gaseous or atomized liquid fuel being injected into the combustion chamber (2) through the air fuel input tube (1) to produce intense heat. Exhaust from a pollution source is input to the system via the Engine Exhaust gases input tube (not shown). Wherein the combustion chamber (2) is used for heating the system up to a temperature sufficient to burn any un-burnt hydrocarbon fuel. Whereby virtually all hydrocarbon fuel within the exhaust gases has been digested or destroyed. The incinerator chamber (3) is used for receiving the superheated gases from the combustion chamber (2) and will eliminate all pollutant material within the gases being digested or destroyed in the combustion chamber (2) as well as any un-burnt fuel and is allowed to burn as hot as possible. The mixing and/or water-heating chamber (4) will reduce any remaining fuel to native elements through heating and retaining the gases in the chamber and also the mixing and/or water-heating chamber (4) is used to heat the two sets of coils enclosed within the last chamber.

It can now be seen the water heating chamber system of the present invention causes turbulence which in turn produces abundant heat that is transferred through the centralized turbulator openings (11) of turbulator disks (10) and into the incinerator chamber (3). In the incinerator chamber (3) the hot gases continue to be mixed and delayed and any remaining hydrocarbons are consumed. This mixing, delaying or dwell time will cause total combustion of the fuel used for heating the water that is contained in the coils (6 & 7) within the mixing and/or water-heating chamber (4). Thus, when passing through the turbulator opening (11) and then into the mixing and/or water-heating chamber (4) the clean hot gases cause the coils (6 and 7) to become hot and in turn heating the water contained inside them to the desired temperature. Whereby producing hot water which is accessible for use from exhaust port (8).

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described my invention, what I claim as new and desire to secure by Letters Patent is:

1. A water heating system in combination comprising: an exterior housing; an elongated tubular member; an outside coil arrangement; an outer coil arrangement; an inner coil arrangement; and flow conditioners; said elongated tubular member being located within said exterior housing yet spaced apart from said exterior housing so as to form an internal space there between, said flow conditioners providing turbulator discs having centralized turbulator openings, said elongated tubular member is partitioned by said flow conditioners so as to form a combustion chamber, an incinerator chamber and a mixing and/or water-heating chamber, each said chamber being in open communication with each other via said centralized turbulator openings, thus each said chamber are arranged in sequence inline, said combustion chamber includes an inlet duct for receiving ignited fuel and air mixture that is blown there through, said outside coil arrangement is located within said internal space, said outer coil arrangement and said inner coil arrangement are located within said mixing and/or water-heating chamber, said outside coil arrangement provides a fresh water inlet for receiving fresh water therein and a transition tube for delivery said fresh water to said outer coil arrangement, said inner coil arrangement provides a hot water outlet, said housing provides an exhaust port, said flow conditioners allow gases to flow in a controlled manner within each said chamber in a direction that delays said gases from flowing straight out of each said chamber due to said flow conditions providing turbulator discs having centralized turbulator openings, whereby;

when said ignited fuel and air mixture is blown into said inlet duct a primary turbulence zone is established within said combustion chamber wherein near total combustion of said ignited fuel and air mixture is accomplished, said ignited fuel and air mixture within said turbulence zone is controlled by velocity of incoming fresh air and fuel as supplied thereto which in turn produces abundant heat that is then transferred through said centralized turbulator openings into said incinerator chamber wherein any remaining pollutants, unburnt fuel or any remaining hydrocarbons are completely consumed, thereafter said abundant heat is transferred into said mixing and/or water-heating chamber and heats said fresh water contained within said outer coil arrangement and said inner coil arrangement thus resulting in production of hot water that is accessible for use and which is environmentally friendly.

2. The water heating system of claim 1 wherein said exterior housing is cylindrical in shape.

3. The water heating system of claim 2 wherein said exterior housing is made from a metal shell containing an insulated material to contain heat resulting in improved efficiency and economy.

4. The water heating system of claim 1 further includes a fuel injector system.

5. The water heating system of claim 4 wherein said fuel injector system injects said fuel that has been converted from a liquid state into a gaseous state.

6. The water heating system of claim 4 wherein said fuel injector system further includes an atomizer for converting said fuel from a liquid state into a gaseous state.

* * * * *